US006441328B1

(12) United States Patent
Matejka et al.

(10) Patent No.: US 6,441,328 B1
(45) Date of Patent: Aug. 27, 2002

(54) ELECTRICAL SERVICE SWITCHING DEVICE

(75) Inventors: Rainer Matejka, Eppelheim; Richard Kommert, Heidelberg, both of (DE)

(73) Assignee: ABB Patent GmbH, Mannheim, DE (US)

( * ) Notice: Subject to any disclaimer, the term of this patent is extended or adjusted under 35 U.S.C. 154(b) by 0 days.

(21) Appl. No.: 09/504,277

(22) Filed: Feb. 15, 2000

(30) Foreign Application Priority Data

Feb. 15, 1999 (DE) ..... 199 06 236

(51) Int. Cl.[7] ..... H01H 9/02

(52) U.S. Cl. ..... 200/330; 200/303; 200/307; 335/132; 335/202

(58) Field of Search ..... 200/17 R, 400, 200/401, 293, 303, 307, 330, 334; 335/132, 202

(56) References Cited

U.S. PATENT DOCUMENTS 4,595,812 A * 6/1986 Tamaru et al. ..... 200/307
4,622,444 A * 11/1986 Kandatsu et al. ..... 200/303
4,926,148 A * 5/1990 Cambreleng ..... 335/13
4,928,079 A * 5/1990 Male et al. ..... 335/13
5,001,315 A * 3/1991 Runyan et al. ..... 200/307
5,003,139 A * 3/1991 Edds et al. ..... 200/401
5,921,380 A * 7/1999 Beck et al. ..... 200/307
5,969,587 A * 10/1999 Combas ..... 335/132

* cited by examiner

*Primary Examiner*—Michael Friedhofer
(74) *Attorney, Agent, or Firm*—Laurence A. Greenberg; Werner H. Stemer; Gregory L. Mayback

(57) ABSTRACT

An electrical service switching device includes a contact point, a moveable contact piece, an auxiliary switch associated with the contact point and having a coupling element and an auxiliary switch contact point coupled to the moveable contact piece, the coupling element actuating the auxiliary switch contact point, and a T-shaped housing. The housing has a transverse web with two trailing narrow-side walls and a fastening surface perpendicular to the two trailing narrow-side walls, a longitudinal web with a leading front surface parallel to the fastening surface, leading narrow-side walls on both sides of the leading front surface, the leading narrow-side walls perpendicular to the leading front surface, and two trailing front surfaces parallel to the fastening surface. At least one of the two trailing front surfaces connects the transverse web and the longitudinal web. The auxiliary switch is releasably attachable to the housing. The electrical service switching device is preferably a circuit-breaker or a residual-current-operated circuit-breaker. The auxiliary switch displays the switch position and is inserted into one of the openings through which supply leads connect to the supply terminals.

12 Claims, 1 Drawing Sheet

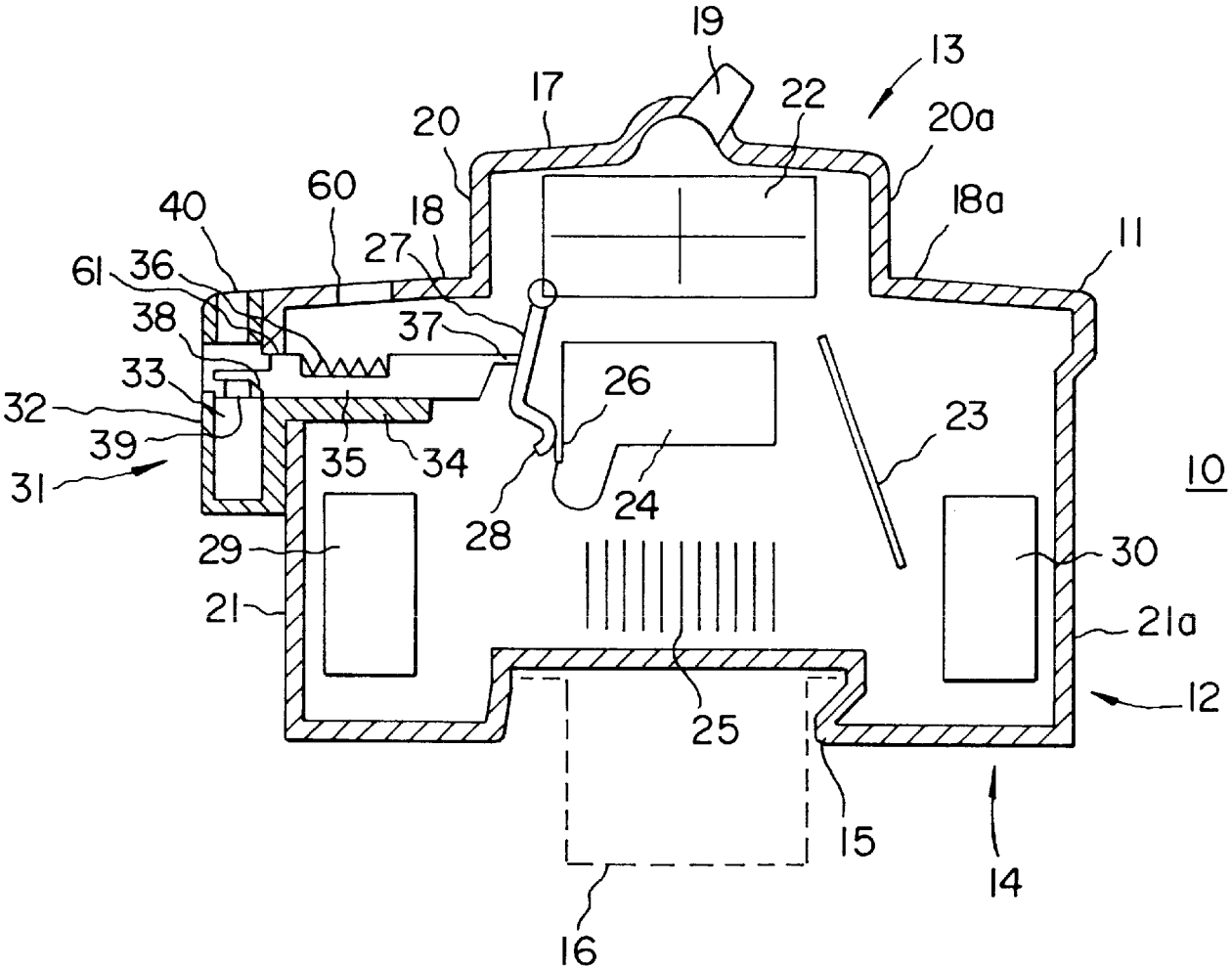
10
11
12
13
14
15
16
17
18
18a
19
20
20a
21
21a
22
23
24
25
26
27
28
29
30
31
32
33
34
35
36
37
38
39
40
60
61

ELECTRICAL SERVICE SWITCHING DEVICE

BACKGROUND OF THE INVENTION

FIELD OF THE INVENTION

The invention lies in the field of electrical connectors. The invention relates to an electrical service switching device. Service switching devices are circuit-breakers or residual-current-operated circuit-breakers that have at least one single contact point or twin contact point and whose housing is approximately T-shaped. In the configuration, a fastening surface, located on the free longitudinal surface of the transverse web of the T shape, allows the service switching device to be fastened on a top-hat rail or similar rails. Running parallel to the fastening surface is a leading front surface located on the end face of the longitudinal web of the T shape. Also parallel to the fastening surface are two trailing front surfaces disposed on the transverse beam of the T shape. Narrow-side walls, running perpendicular to the two trailing front surfaces, are provided on the end faces of the transverse web and on the lateral surfaces of the longitudinal web.

Service switching devices require the determination and display of the switch position of the contact point on the service switching device, something that is mostly performed with the aid of an auxiliary switch. In the case of circuit-breakers and residual-current-operating circuit-breakers, the auxiliary switches are attached laterally to one of the broadside surfaces, and suitable coupling elements are used to transmit the switch position of the moveable contact piece or, if appropriate, the contact bridge to the auxiliary switch so that the switch position can be displayed.

A conventional configuration in which one of the trailing front surfaces in the region of the web has an opening into which an auxiliary switch can be inserted parallel to the web is found in European published, non-prosecuted patent application No. EP 0 511 042 B1. The configuration is applicable for starting circuit-breakers. In the case of circuit-breakers or residual-current-operated circuit-breakers, however, the auxiliary switches are laterally aligned because there is not sufficient space for inserting an auxiliary switch into the opening of the trailing front wall due to the configuration of the distribution boards with covers.

SUMMARY OF THE INVENTION

It is accordingly an object of the invention to provide an electrical service switching device that overcomes the hereinafore-mentioned disadvantages of the heretofore-known devices of this general type and in which the auxiliary switch can be fixed on the service switching device in a simple and space-saving way With the foregoing and other objects in view, there is provided, in accordance with the invention, an electrical service switching device, including at least one contact point, a moveable contact piece, an auxiliary switch associated with the at least one contact point and having a coupling element and an auxiliary switch contact point coupled to the moveable contact piece, the coupling element actuating the auxiliary switch contact point, and an approximately T-shaped housing having a transverse web with two trailing narrow-side walls and a fastening surface approximately perpendicular to the two trailing narrow-side walls, a longitudinal web with a leading front surface approximately parallel to the fastening surface, leading narrow-side walls on both sides of the leading front surface, the leading narrow-side walls approximately perpendicular to the leading front surface, and two trailing front surfaces approximately parallel to the fastening surface, at least one of the two trailing front surfaces connecting the transverse web and the longitudinal web, the auxiliary switch formed to releasably attach to the housing.

In accordance with another feature of the invention, the at least one contact point is at least one of a group consisting of a single contact point and a twin contact point.

In accordance with a further feature of the invention, the coupling element is disposed transverse to the two trailing narrow-side walls.

In accordance with an added feature of the invention, the auxiliary switch is releasably attached to the transverse web.

In accordance with an additional feature of the invention, the auxiliary switch is releasably attached to one of the two trailing narrow-side walls.

The auxiliary switch can be attached to one of the narrow-side walls and can be coupled to the moveable contact piece through a coupling element that actuates the auxiliary switch contact point and runs transverse to the narrow-side wall. Preferably, the auxiliary switch is fastened on the end face of the transverse web for circuit-breakers or residual-current-operated circuit-breakers. The configuration avoids a necessary widening of the web of the T-shape in the region of the leading front surface, resulting in no hindrance to installation in a distribution board having a front cover. The width of the auxiliary switch corresponds to the module width of a circuit-breaker pole. The auxiliary switch width corresponds to the width of a circuit-breaker module or residual-current-operated circuit-breaker module, resulting in no overlap of the broadsides of the service switching device by the auxiliary switch.

In accordance with yet another feature of the invention, the housing has first openings on the two trailing front surfaces and second openings on the two trailing narrow-side walls, and including supply terminals disposed in the housing, accessible through the first openings, and formed to receive supply leads through the second openings, the auxiliary switch being formed to be inserted with the coupling element into at least one of the first openings and the second openings to engage the coupling element with the moveable contact piece.

The service switching device has an opening at the point where the auxiliary switch is fastened. In the opening, for example, it is possible to insert a supply lead. In the configuration according to the invention, the insertion opening for a supply lead is used for fastening the auxiliary switch on the service switching device. For this reason, the opening must not be closed if the auxiliary switch should not be attached. Such is also true when an additional opening is provided merely for inserting the auxiliary switch. Latching elements can serve to fix the auxiliary switch housing. The latching elements can be used to fix the auxiliary switch housing on the housing of the service switching device.

In accordance with yet a further feature of the invention, the coupling element is a slider actuating the auxiliary switch contact point.

Advantageously, the coupling element is a slider that is pressed under the force of a spring against the moveable contact piece, for example, against a contact bridge, or against a deflection lever connected to the contact bridge, or against the contact lever.

In accordance with yet an added feature of the invention, the auxiliary switch contact point is a microswitch.

In accordance with yet an additional feature of the invention, the auxiliary switch contact point is a microswitch and the slider has a cam surface actuating the microswitch.

The auxiliary switch preferably includes a microswitch that is disposed in the auxiliary switch housing. A cam surface is provided on the coupling element (i.e., the slider). The cam surface actuates the microswitch when the slider is moved to and fro.

In accordance with again another feature of the invention, the auxiliary switch has a front side and housing supply terminals accessed from the front side.

In accordance with again a further feature of the invention, the coupling element is pressed permanently and resiliently against the moveable contact piece.

In accordance with again an added feature of the invention, the moveable contact piece has a pivotable contact lever for supporting the moveable contact piece, the coupling element is a slider, and the slider engages the contact lever.

In accordance with again an additional feature of the invention, there is provided two stationary contact pieces and a contact bridge bridging the two stationary contact pieces, the coupling element engaging the contact bridge.

In accordance with still another feature of the invention, the coupling element is a pivoting lever.

With the objects of the invention in view, there is also provided a circuit-breaker, including at least one contact point, a moveable contact piece, an auxiliary switch associated with the at least one contact point and having a coupling element and an auxiliary switch contact point coupled to the moveable contact piece, the coupling element actuating the auxiliary switch contact point, and an approximately T-shaped housing having a transverse web with two trailing narrow-side walls and a fastening surface approximately perpendicular to the two trailing narrow-side walls, a longitudinal web with a leading front surface approximately parallel to the fastening surface, leading narrow-side walls on both sides of the leading front surface, the leading narrow-side walls approximately perpendicular to the leading front surface, and two trailing front surfaces approximately parallel to the fastening surface, at least one of the two trailing front surfaces connecting the transverse web and the longitudinal web, the auxiliary switch formed to releasably attach to the housing.

In accordance with a concomitant feature of the invention, there is also provided a residual-current-operated circuit-breaker, including, at least one contact point, a moveable contact piece, an auxiliary switch associated with the at least one contact point and having a coupling element and an auxiliary switch contact point coupled to the moveable contact piece, the coupling element actuating the auxiliary switch contact point, and an approximately T-shaped housing having a transverse web with two trailing narrow-side walls and a fastening surface approximately perpendicular to the two trailing narrow-side walls, a longitudinal web with a leading front surface approximately parallel to the fastening surface, leading narrow-side walls on both sides of the leading front surface, the leading narrow-side walls approximately perpendicular to the leading front surface, and two trailing front surfaces approximately parallel to the fastening surface, at least one of the two trailing front surfaces connecting the transverse web and the longitudinal web, the auxiliary switch formed to releasably attach to the housing.

Other features that are considered as characteristic for the invention are set forth in the appended claims.

Although the invention is illustrated and described herein as embodied in electrical service switching device, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The sole FIGURE shows a diagrammatic sectional view of and into a circuit-breaker according to the invention.

DESCRIPTION OF THE PREFERRED EMBODIMENTS

Referring now to the single figure of the drawing, it is seen that a circuit-breaker 10 has a housing 11 having a T shape with a transverse web 12 and a longitudinal web 13. The transverse web 12 runs parallel to the fastening surface 14 of the circuit-breaker 10, and has on the fastening surface 14 a cutout with a stationary nose 15 and a non-illustrated moveable nose, behind a top-hat rail 16 (illustrated by dashes).

Because of the T shape, the circuit-breaker 10 has a leading front surface 17 and two trailing front surfaces 18, 18*a*, a toggle switch 19 projecting from the leading front surface 17. Located between the leading front surface 17, which is situated in the end face of the longitudinal web 13, and the two trailing front surfaces 18 are leading narrow-side walls 20 and 20*a*, and trailing narrow-side surfaces 21, 21*a* are provided between the trailing front surfaces 18, 18*a* and the fastening surface 14. The narrow-side surfaces 21, 21*a* run approximately perpendicular to the front surface 17 and to the fastening surface 14.

In the configuration according to the sole figure, the circuit-breaker 10 has a breaker mechanism 22 that is connected (in a non-illustrated way) to the toggle switch 19, a thermostatic bimetallic strip 23, a magnetic trip element 24 and an arc-quenching configuration 25. In a conventional manner, a stationary contact piece 26, which cooperates with a moveable contact piece 28 fastened on a contact lever 27 is located on the magnetic trip element 24. The sole figure shows the contact point with the two contact pieces 26, 28 in the closed state. Supply terminals 29, 30 are located on both sides of each of the magnetic trip element 24, the stationary contact piece 26, contact lever 27, and the moveable contact piece 28.

An auxiliary switch 31 is fitted, preferably, latched, on the trailing narrow-side wall 21 that is adjoined by the fastening surface 14 and is next to the contact lever 27. The auxiliary switch 31 has a housing 32 in which a microswitch 33 is located. The housing 32 has a guide arm 34 on which a slider 35 can be displaced to and fro parallel to the fastening surface 14, the slider 35 being permanently pressed inwards against the contact lever 27 by a compression spring 36. On one side of the slider is a nose 37 that bears against the contact lever 27. On the opposite side of the slider in the region of the auxiliary switch 31 and/or the microswitch 33 is a cam surface that is formed by a sloping surface 38. The switching plunger 39 of the microswitch 33 is actuated through the sloping surface 38 whenever the slider 35 is displaced to the left (as viewed in the figure). When the slider 35 is displaced to the left, the contact lever 27 reaches an open position during a switching operation. The sloping surface 38 then runs onto the actuating plunger 39 and opens or closes the microswitch 33, and vice-versa, depending on how the microswitch is connected. The auxiliary switch housing 32 also has supply terminals 40 that, just like the supply terminals 29, 30, can be actuated from the front side of the housing 11.

In the installed position, the housing guide arm 34 and the slider 35 are inserted into the housing 11 parallel to the fastening surface 14 through an opening serving to connect a lead. The housing 11 can have first openings 60 on the two trailing front surfaces 18, 18*a*, and second openings 61 on the two trailing narrow-side walls 21, 21*a*. The supply terminals 29, 30 disposed in the housing 11 can be accessible through the first openings 60, and the second openings 61 can be formed to receive supply leads. The auxiliary switch 31 can be formed to be inserted with the coupling element 35, 36, 37, into at least one of the first openings 60 and the second openings 61 to engage the coupling element with the contact lever 27 and the moveable contact piece 28.

In the direction of the longitudinal extent of the top-hat rail 16 (a direction transverse to the plane of the drawing figure), the width of the auxiliary switch 31 corresponds exactly to the module width, for example, of a circuit-breaker pole. Accordingly, the auxiliary switch 31 does not overlap the circuit-breaker module 10 on both sides.

As a consequence of fitting the auxiliary switch 31 module on the trailing narrow-side surface 21, covers in the distribution board that run parallel to the fastening surface 14 or the leading front surface 17 and that adjoin the front narrow-side walls 20, 20*a* are not hindered by the auxiliary switch 31 attachment.

A further advantage is achieved when the auxiliary switch 31 can be plugged into an opening on the trailing narrow-side surface 21 and latched there. Such an opening, which can be provided in addition to a terminal connection opening, need not be closed separately when an auxiliary switch 31 is provided.

It is shown in the drawing that the coupling element runs approximately perpendicular to the trailing narrow-side surface 21. Depending on the configuration of the contact lever 27, it is also possible for the coupling element to be disposed in a sloping fashion (i.e., at an angle) relative to the narrow-side surface 21.

We claim:

1. An electrical service switching device, comprising:

at least one contact point;

a moveable contact piece;

an auxiliary switch associated with said at least one contact point and having a coupling element and an auxiliary switch contact point coupled to said moveable contact piece, said coupling element actuating said auxiliary switch contact point; and an approximately T-shaped housing having:

a transverse web with two trailing narrow-side walls and a fastening surface approximately perpendicular to said two trailing narrow-side walls;

a longitudinal web with a leading front surface having two sides and being approximately parallel to said fastening surface, leading narrow-side walls on both of said sides of said leading front surface, said leading narrow-side walls approximately perpendicular to said leading front surface; and two trailing front surfaces approximately parallel to said fastening surface, at least one of said two trailing front surfaces connecting said transverse web and said longitudinal web;

said auxiliary switch and said coupling element being releasably attached to said housing at one of said two trailing narrow-side walls.

2. The service switching device according to claim 1, wherein said coupling element is disposed transverse to said two trailing narrow-side walls.

3. The service switching device according to claim 1 wherein said auxiliary switch is releasably attached to said transverse web.

4. The service switching device according to claim 1, wherein said housing has first openings on said two trailing front surfaces and second openings on said two trailing narrow-side walls, and including supply terminals disposed in said housing and accessible through said first openings for receiving supply leads through said second openings, said auxiliary switch to be inserted with said coupling element into at least one of said first openings and said second openings to engage said coupling element with said moveable contact piece.

5. The service switching device according to claim 4, wherein said auxiliary switch contact point is a microswitch and said slider has a cam surface actuating said microswitch.

6. The service switching device according to claim 1, wherein said coupling element is a slider actuating said auxiliary switch contact point.

7. The service switching device according to claim 1, wherein said auxiliary switch contact point is a microswitch.

8. The service switching device according to claim 1, wherein said auxiliary switch has a front side and housing supply terminals to be accessed from said front side.

9. The service switching device according to claim 1, wherein said moveable contact piece has a pivotable contact lever for supporting said moveable contact piece, said coupling element is a slider, and said slider engages said contact lever.

10. The service switching device according to claim 1, wherein said coupling element is a pivoting lever.

11. A circuit-breaker, comprising:

at least one contact point;

a moveable contact piece;

an auxiliary switch associated with said at least one contact point and having a coupling element and an auxiliary switch contact point coupled to said moveable contact piece, said coupling element actuating said auxiliary switch contact point; and an approximately T-shaped housing having:

a transverse web with two trailing narrow-side walls and a fastening surface approximately perpendicular to said two trailing narrow-side walls;

a longitudinal web with a leading front surface having two sides and being approximately parallel to said fastening surface, leading narrow-side walls on both of said sides of said leading front surface, said leading narrow-side walls approximately perpendicular to said leading front surface; and two trailing front surfaces approximately parallel to said fastening surface, at least one of said two trailing front surfaces connecting said transverse web and said longitudinal web; said auxiliary switch and said coupling element being releasably attached to said housing at one of said two trailing narrow-side walls.

12. A residual-current-operated circuit-breaker, comprising:

at least one contact point;

a moveable contact piece;

an auxiliary switch associated with said at least one contact point and having a coupling element and an auxiliary switch contact point coupled to said moveable contact piece, said coupling element actuating said auxiliary switch contact point; and an approximately T-shaped housing having:

a transverse web with two trailing narrow-side walls and a fastening surface approximately perpendicular to said two trailing narrow-side walls;

a longitudinal web with a leading front surface having two sides and being approximately parallel to said fastening surface, leading narrow-side walls on both of said sides of said leading front surface, said leading narrow-side walls approximately perpendicular to said leading front surface; and two trailing front surfaces approximately parallel to said fastening surface, at least one of said two trailing front surfaces connecting said transverse web and said longitudinal web;

said auxiliary switch and said coupling element being releasably attached to said housing at one of said two trailing narrow-side walls.

* * * * *